United States Patent [19]

Hiraga et al.

[11] 4,005,948

[45] Feb. 1, 1977

[54] LUBRICATION SYSTEM FOR COMPRESSOR UNIT

[75] Inventors: Masaharu Hiraga, Isesaki; Shigemi Shimizu, Sakai, both of Japan

[73] Assignee: Sankyo Electric Co., Ltd., Isesaki, Japan

[22] Filed: Sept. 8, 1975

[21] Appl. No.: 611,161

[30] Foreign Application Priority Data

Oct. 9, 1974 Japan ..... 49-117547
Mar. 15, 1975 Japan ..... 50-31562

[52] U.S. Cl. ..... 417/269; 184/6.17
[51] Int. Cl.[2] ..... F04B 1/12; F01M 1/00
[58] Field of Search ..... 417/269; 184/6.16, 6.17, 184/11 R

[56] References Cited

UNITED STATES PATENTS

| | | | |
|---|---|---|---|
| 3,085,514 | 4/1963 | Budzich | 417/203 |
| 3,209,701 | 10/1965 | Phinney | 417/269 |
| 3,712,759 | 1/1973 | Olson | 417/269 |
| 3,785,458 | 1/1974 | Caldwell et al. | 184/11 R |
| 3,838,942 | 10/1974 | Pororny | 417/269 |
| 3,857,462 | 12/1974 | Kaufman et al. | 184/11 A |

*Primary Examiner*—William L. Freeh
*Assistant Examiner*—G. P. LaPointe
*Attorney, Agent, or Firm*—Hopgood, Calimafde, Kalil, Blaustein & Lieberman

[57] ABSTRACT

A lubrication system for use in a compressor unit includes a deflector projecting from the inner wall of the compressor housing which collects lubricating oil splashed onto the housing wall and channels the lubricating oil thus collected to the shaft seal cavity.

16 Claims, 18 Drawing Figures

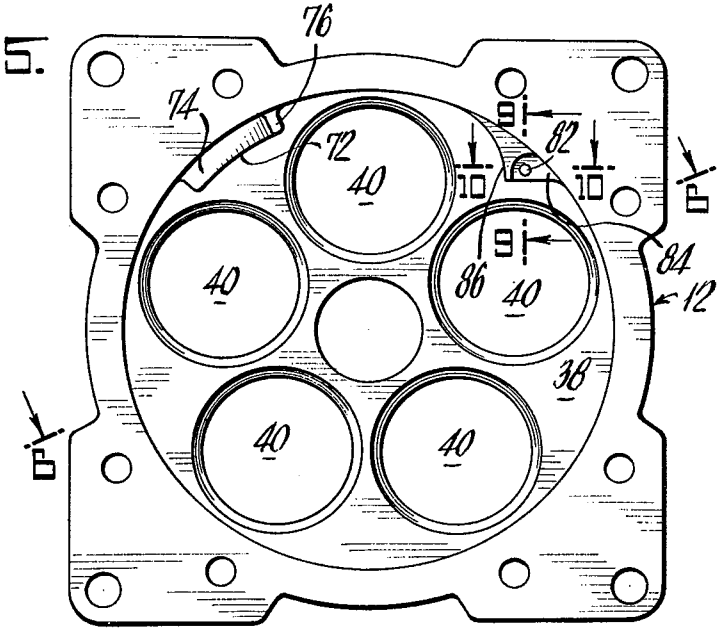
Fig. 5.
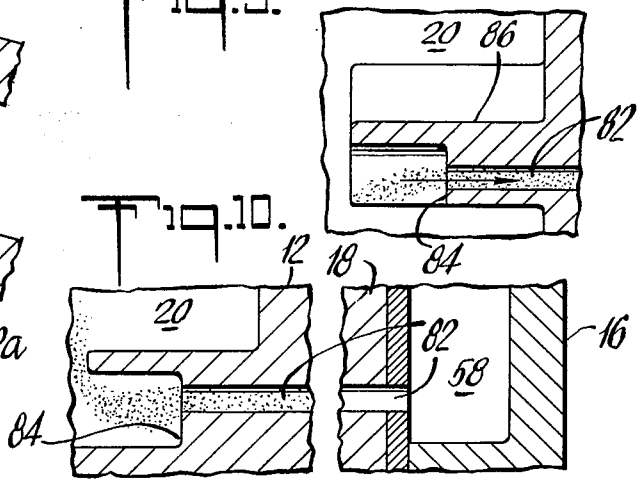
Fig. 9.
Fig. 10.
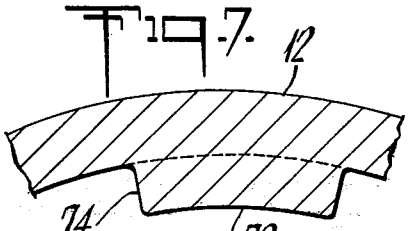
Fig. 7.
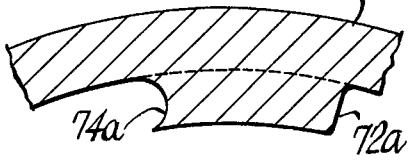
Fig. 8.
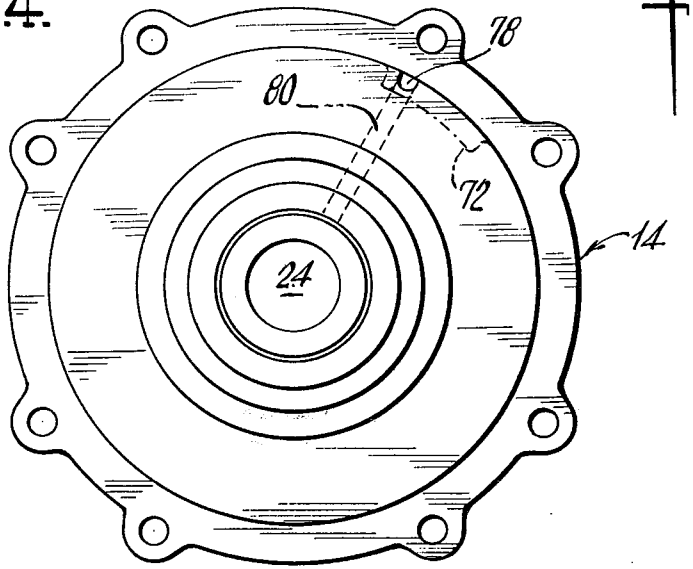
Fig. 4.
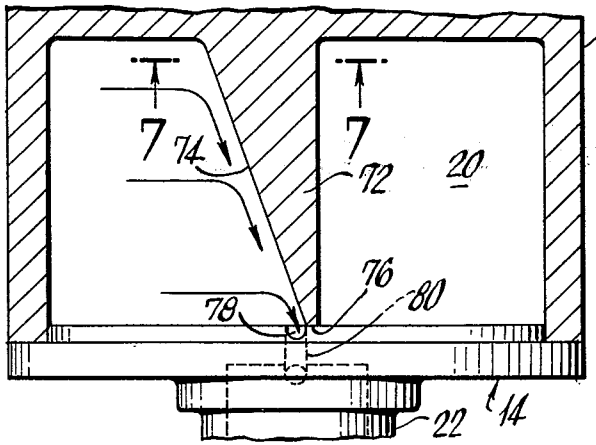
Fig. 6.

Fig. 11.
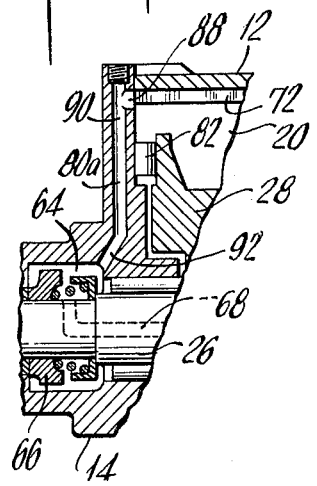
Fig. 12.
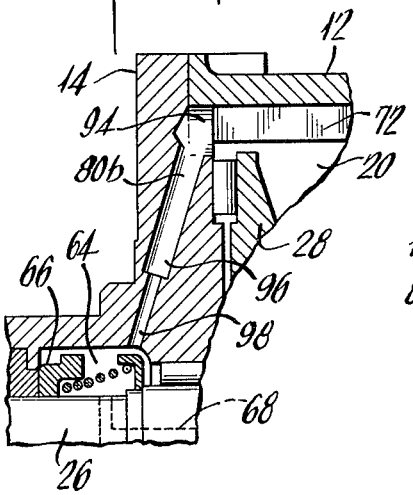
Fig. 13.
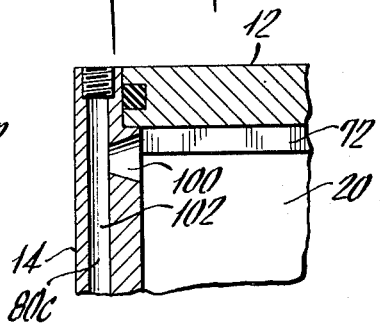
Fig. 14.
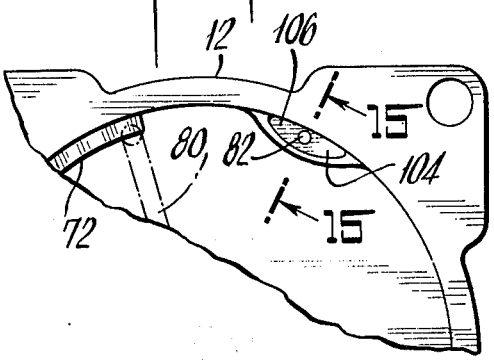
Fig. 17.
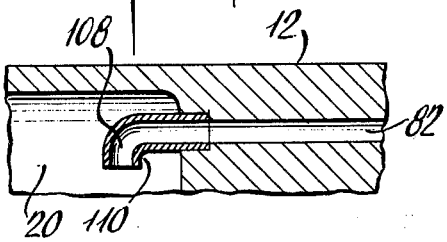
Fig. 15.
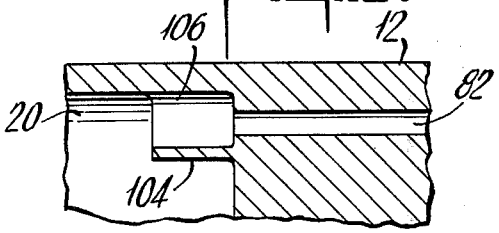
Fig. 18.
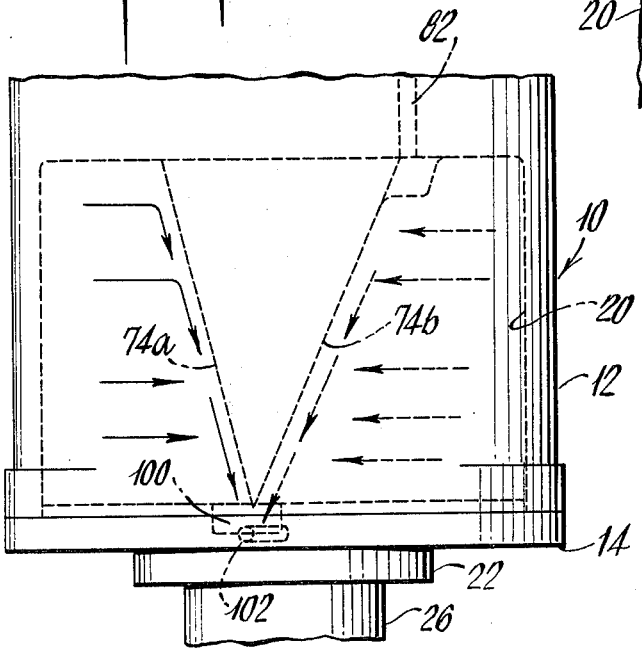
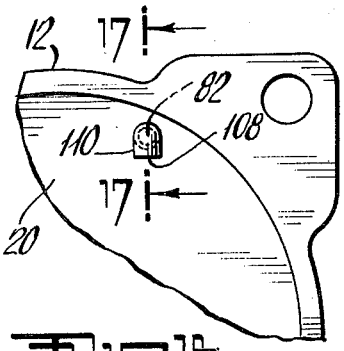
Fig. 16.

LUBRICATION SYSTEM FOR COMPRESSOR UNIT

The present invention relates generally to compressors, and more particularly to an improved means for providing lubrication in a refrigerant compressor.

In the conventional refrigerant compressor, a charge of refrigerant gas and lubricating oil is introduced. The refrigerant is compressed by a plurality of pistons which axially reciprocate within a corresponding plurality of cylinders. The reciprocal movement of the pistons is, in turn, produced by the cooperation of a rotating cam rotor or swash plate and a rotating wobble plate which convert the rotation of an input shaft to the desired reciprocal movement of the pistons. The compressed refrigerant is fed out of the compressor to a refrigerating unit and a quantity of lubricating oil is separated from the input charge and passed into the compressor to lubricate desired components of the compressor, such as the thrust bearings.

It is desirable in the operation of such a compressor that the amount of lubricating oil circulating in the compressor be appropriate to the compressor operating speed. Moreover, it is generally desirable to utilize a minimum amount of lubricating oil and to minimize, if not prevent, the discharge or outflow of lubricating oil from the compressor to the refrigerating unit; the reduction of the oil discharge increases the operating efficiency of the condensor and evaporator of the heat exchanger.

In one recent attempt to improve the lubrication of a refrigerant compressor, as described in U.S. Pat. No. 3,838,942 to Pokorny, the lubricating fluid is caused to flow through and over the thrust bearings by the difference in pressures at various sections of the compressor. The lubricating oil is caused to flow through a port formed in the peripheral shell of the compressor housing to the suction chamber, and is returned through the cylinders by the blow-by action to a sump from where it is recirculated through the shaft seal cavity to the bearings and moving surfaces of the compressor.

It has been found, however, that a compressor unit of the type disclosed in the Pokorny patent is subject to the loss of lubricating oil as a result of the discharge of oil from the compressor to the refrigerant unit. This loss of lubricating oil may reduce the amount of oil flowing in the compressor to below a minimum amount for safe and reliable compressor operation, and may cause some of the compressor parts to seize or burn. The discharge of oil from the compressor also reduces the efficiency of the heat exchanger (condensor and evaporator) of the refrigerant unit. Further, some of the lubricating oil in the known compressors, as exemplified in the Pokorny-type compressor, sticks to the wall of the housing which still further reduces the amount of oil available for lubrication.

The prior art compressors thus require a relatively large amount of lubricating oil, which reduces the efficiency of operation of the refrigeration system of which the compressor is a part, while still not ensuring a sufficient amount of lubricating oil at all times during compressor operation. The known refrigerant compressors of the type described are thus subject to failure and reduced operating efficiencies.

It is an object of the present invention to provide an improved and more efficient lubrication system for use in a refrigerant compressor or the like.

It is another object of the invention to provide a lubrication system of the type described in which the lubricating rate is nearly proportional to the compressor speed.

It is yet another object of the present invention to provide a compressor of the type described in which the discharge of lubricating oil from the compressor is substantially reduced.

It is a general object of the present invention to provide a refrigerant compressor of the type described which is reliable in operation, contains a minimum number of moving parts, and operates at significantly lower noise levels.

To these ends, the compressor unit of the present invention includes a deflector member depending from the interior wall of the casing or housing of the compressor for collecting and then directing oil spattered onto the housing interior wall during compressor operation to a port or oil hole in communication with the shaft seal cavity from which the lubricating oil circulates into the crank chamber of the compressor and through the thrust bearings and other moving components of the compressor.

To the accomplishment of the above and other objects, the present invention relates to a compressor substantially as set forth in the appended claims and described in the following detailed specification as considered with the accompanying drawings in which:

FIG. 4 is an end view of the front housing of the compressor;

FIG. 5 is a end view of the compressor housing;

FIG. 6 is a partial cross-section taken along line 6—6 of FIG. 5;

FIG. 7 is a partial cross-section of the oil deflector of the compressor taken along line 7—7 of FIG. 6;

FIG. 8 is a cross-section of an alternative oil deflector for use in the compressor;

FIG. 9 is a partial cross-section taken along line 9—9 of FIG. 5;

FIG. 10 is a partial cross-section taken along line 10—10 of FIG. 5;

FIG. 11 is a fragmentary cross-section of a compressor according to another embodiment of the invention;

FIG. 12 is a fragmentary cross-section of a compressor according to another embodiment of the invention;

FIG. 13 is a fragmentary cross-section of a compressor according to a further embodiment of the invention;

FIG. 14 is a fragmentary end elevation illustrating a variation in the arrangement of the pressure-balancing hole shown in the embodiment of FIG. 5;

FIG. 15 is a cross-sectional view taken along line 15—15 of FIG. 14;

FIG. 16 is a fragmentary end elevation showing yet another arrangement of the pressure-balancing hole according to the invention;

FIG. 17 is a cross-section taken along the line 17—17 of FIG. 16; and

FIG. 18 is a fragmentary top plan view of a compressor illustrating an alternate configuration of an oil deflector for use in the compressor of the invention.

Figure 1:
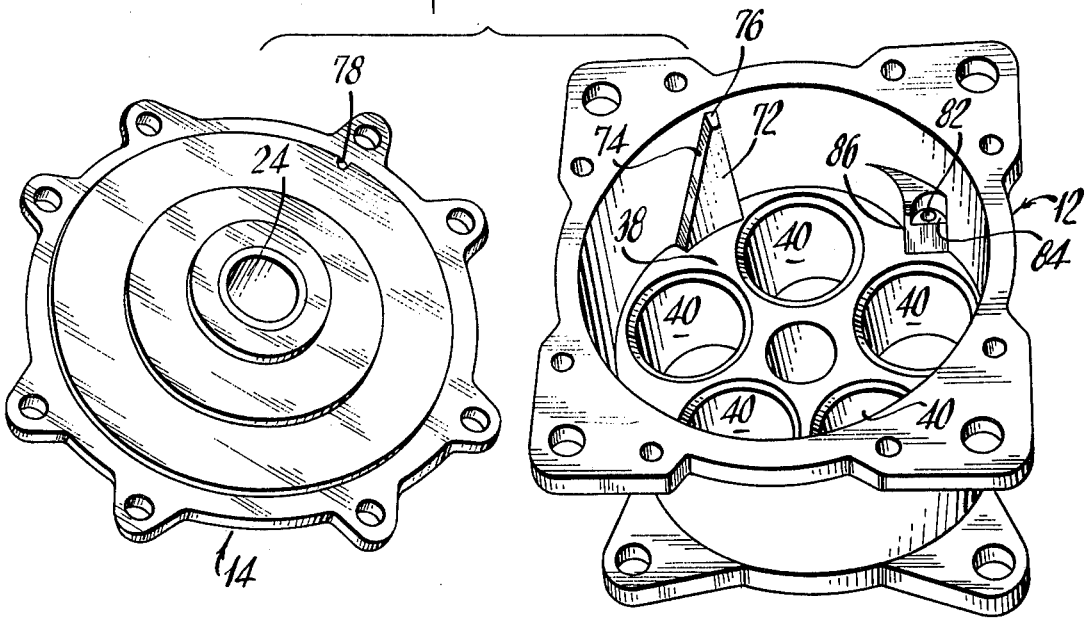
FIG. 1 is an exploded view showing in perspective the front housing and the interior of the cylindrical casing of a compressor according to one embodiment of the present invention.

Referring to the embodiment of the invention illustrated in FIGS. 1–10, there is shown a compressor generally designated 10 which includes a substantially cylindrical housing 12 having a front housing or cover plate 14 at one end and a cylinder head 16 secured to its opposite ends by any suitable means such as screws. A valve plate assembly 18 is interposed between housing 12 and cylinder head 16.

The interior of housing 12 defines a crank chamber 20 at its front end and cover plate 14 includes a central hub 22 having a central opening 24 through which a main shaft 26 passes into the interior of housing 12. At its inner end, shaft 26 is attached by any suitable means to a swash plate or cam rotor 28, such that cam rotor 28 is rotated along with shaft 26. The outer end of shaft 26, which extends outwardly from the compressor housing, is adapted to be driven, such as by a conventional clutch and pulley connection, to the motor of the vehicle in which the compressor is contained.

The sloping surface of cam rotor 28 is placed in close proximity with the surface of a wobble plate 30 mounted on an oscillating bevel gear 32. The latter is able to nutate or oscillate about a ball bearing 34 seated within a fixed bevel gear 36.

Figure 3:
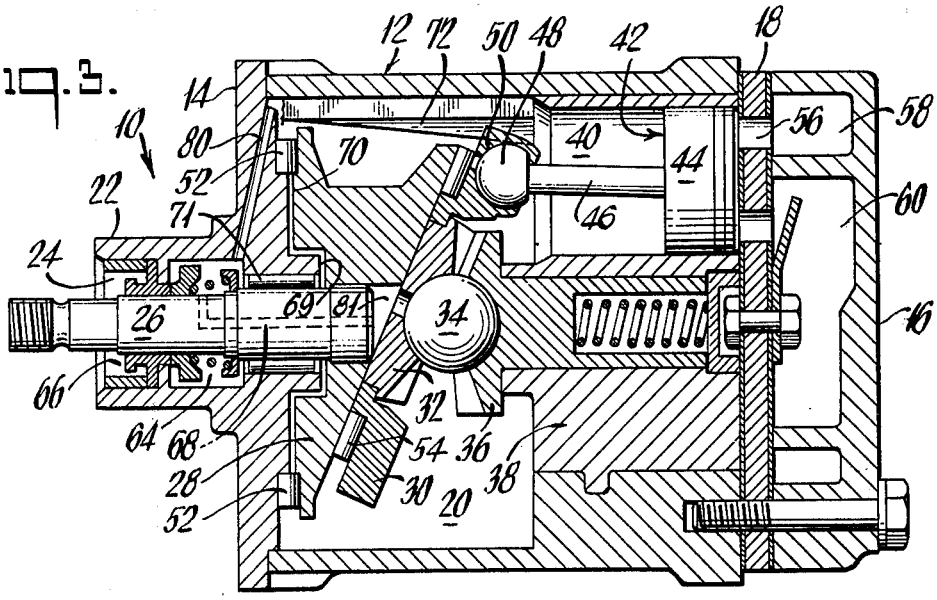
FIG. 3 is a vertical cross-section taken along line 3—3 of FIG. 2.
Figure 2:
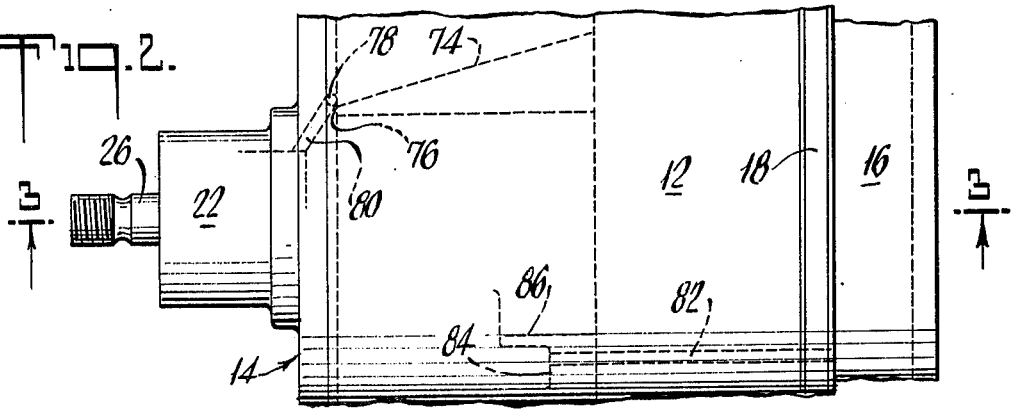
FIG. 2 is a partial plan view of the compressor.

A cylinder assembly 38 is provided within housing 12 and, in the embodiment shown, has five cylinders 40 formed therein. Each cylinder receives a piston 42 having a head 44 and a rod 46 attached at one of its ends to a ball 48 which is received in a socket 50 formed in wobble plate 30. It should be understood that although only one such ball-socket connection is shown in FIG. 3, in the embodiment shown there are five such sockets arranged peripherally around the wobble plate to respectively receive the five pistons employed in the disclosed embodiment. A thrust bearing 52 is positioned between the adjoining surfaces of cam rotor 28 and front housing 14, and a similar thrust bearing 54 is interposed between the adjoining surfaces of the cam rotor 28 and wobble plate 30. The cylinder head 16 of the compressor is shaped to define a suction valve port 56, a suction chamber 58, and a discharge chamber 60.

In the operation of the compressor, as is known, oil in the crankcase is agitated and lubricates the internal moving parts in the form of oil mist. On the other hand, an oil-refrigerant mixture which is discharged from the compressor, is returned to the compressor through an inlet port (not shown) into the suction chamber where the refrigerant is introduced through the valve port into the cylinder where it is compressed by the reciprocating movement of the pistons caused by the nutation of the wobble plate imparted thereto by the rotation of the cam rotor. The compressed oil-refrigerant mixture is partly discharged into the discharge chamber from where it leaves the compressor to an external refrigeration system through an outlet port (also not shown). A portion of the lubricating oil is separated from the charge and passes into the compressor interior where it is utilized to lubricate the moving parts of the compressor again.

The front housing 14 of the compressor is shaped to define a shaft seal cavity 64 which contains a shaft seal 66, both of which are concentrically disposed about main shaft 26. Shaft seal cavity 64 communicates with an oil passageway 68 formed axially in the mainshaft 26. Passageway 68, through which lubricating oil is passed over thrust bearing 54, effects communication between the shaft seal cavity and the crank chamber. The clearances 69 between the needle rollers of a main bearing 71 also work as communicating passageways of oil from the shaft seal cavity to the crank chamber.

In the operation of conventional refrigerant compressors, much of the lubricating oil in the interior of the housing is splashed by centrifugal force onto the inner wall of the housing and is thus not available for lubricating the moving parts of the compressor, such as the bearings. To ensure a sufficient amount of oil acting as a lubricant, a relatively large amount of oil must be introduced into the prior art compressors, which tends to reduce the efficiency of lubrication and of compressor operation. In some cases, the unavailability of oil for lubricating purposes has caused the moving parts of the compressor to seize, causing serious and occasionally irreparable damage to the compressor. The present invention is directed toward achieving improved efficiency of lubrication of the compressor.

To this end, the compressor of the present invention includes means to collect a quantity of the oil that is splashed onto the inner wall of the housing during compressor operation, and to direct the thus collected oil over the shaft seal and the bearings, and back to the crank chamber where it is used to lubricate the moving parts of the compressor.

In the embodiment of the invention illustrated in FIGS. 1–10, an oil deflector 72 projects into the crank chamber from the inner wall of the compressor housing. As seen best in FIGS. 1, 2 and 6, deflector 72 may be in the form of a right triangle, as viewed in plan, having a surface 74 which tapers toward the front end of the housing and terminates in a flat tip 76 which touches the inner wall of front housing 14 adjacent but offset from an oil opening 78 (FIG. 7) formed in front housing 14. Opening 78 communicates with shaft seal cavity 64 through an oil passageway 80 formed in the interior of front housing 14 and terminating at its lower end at the shaft seal cavity.

In operation, as the main shaft and cam rotor rotate, lubricating oil is splashed onto the interior wall of the housing. Rather than merely collecting there and thus not being available for lubrication, as in the prior art compressors, the oil on the interior wall of the compressor is collected along the tapered surface 74 of deflector 72, and is thereby directed to flow along that surface, as indicated by the arrows in FIG. 6, to opening 78 into which the collected oil is passed. The lubricating oil that is directed in this manner to opening 78 flows through oil passageway 80 into the shaft seal cavity from where it flows partly through passageway 68 to thrust bearings 54 and ball bearing 34, and to crank chamber 20.

The central portion 81 of cam rotor 28 near the opening of passageway 68 becomes a vacuum as a result of the centrifugal forces of fluid inside the crank chamber, which strengthens the oil flow through passageway 68 from the seal cavity to the crank chamber by its sucking action, and the space between front housing 14 and cam rotor 28 also becomes a vacuum by the centrifugal force of fluid which strengthens the oil flow through main bearing 69 and thrust bearing 52.

The deflector 72 may be substantially rectangular in cross-section as shown in FIG. 7, or it may, as in the deflector 72*a* shown in FIG. 8, have a tapered surface 74*a* which is arcuately grooved or channeled to increase the control of oil movement therealong to opening 78.

In another aspect of the invention, means are provided to permit blow-by refrigerant gas from the crank chamber to flow from the crank chamber to the suction chamber in the cylinder head, while substantially preventing any lubricating oil from leaving the crank chamber to the suction chamber, as occurs in the prior art compressors as typified by the one described in the aforesaid Pokorny patent.

To these ends as seen best in FIGS. 1 and 5, a passageway 82 is formed in a member 84 projecting from the inner wall of the cylindrical housing, such that the opening is spaced from the housing interior wall. Member 84 and opening 82 therein are circumferentially spaced along the housing wall from oil deflector 72. As shown in FIGS. 9 and 10, to prevent oil collecting on the interior wall from passing through passageway 82 to the suction chamber, member 84 includes an arcuate wall 86 depending from the housing interior wall and extending below the opening 82 so that oil collecting on the interior wall is isolated from the opening and does not pass therethrough to the suction chamber, as desired.

In the embodiment of the invention illustrated in FIGS. 1–10, oil passageway 80 slopes downward and toward the front end of the compressor. An alternate oil passageway **80*a*, shown in FIG. 11, includes a relatively short horizontal section located directly adjacent the forward tip of oil deflector 72, which effects fluid communication between chamber 2 and a vertical section 90. The lower end of section 90 is in communication with shaft seal cavity 64 through a lower sloping section 92**.

In the embodiment illustrated in FIG. 12, the oil passageway **80*b* includes a chamber 94, which may be, as shown, in the form of an inward pyramidal dome. Chamber 94, which may also be essentially spherical in form, communicates with a relatively wide-diameter downwardly sloping section 96. The latter, in turn, communicates with shaft seal cavity 64 through a reduced-diameter sloping section 98. The stepped reduction in volume of the path along which the lubricating oil passes from the crank chamber 20 to the shaft seal cavity through passageway 80*b* increases the pressure of the oil supplied to the shaft seal cavity as compared to the pressure of the oil at chamber 94**. This increase in oil pressure at the shaft seal cavity has been found to produce a further improvement in the efficiency of lubrication.

FIG. 13 illustrates a further possible configuration of the oil passageway which results in the desired higher oil pressure at the shaft seal cavity. As shown, the oil passageway **80*c* includes a transverse, frusto-conical section 100 tapering toward the front end of the compressor and terminating at the vertical section 102. The latter, in turn, communicates either directly or through a lower sloping section, as shown in FIG. 11, to the shaft seal cavity. Although not shown in FIG. 13, section 100 is also preferably greater in width than the diameter of vertical section 102 (see FIG. 18**).

FIS. 14 and 15 illustrate an alternative arrangement by which lubricating oil is prevented from being discharged from the compressor interior to the suction chamber through pressure-balancing passageway 82. In this embodiment, the arcuate wall 86 of the first-described embodiment is replaced with an arcuate rib 104 which defines an arcuate chamber 106. Chamber 106, in turn, communicates at its inner end with passageway 82. Rib 104 serves to deflect lubricating oil that may be splashed onto the interior wall of the compressor housing from entering into chamber 106, thereby preventing discharge of the oil through passageway 82.

Another arrangement envisioned by the invention to prevent the undesired discharge of oil through the pressure-balancing passageway is illustrated in FIGS. 16 and 17 in which the inner end of passageway 82 is terminated in an extension tube 108 which has its free end terminating in a downward portion 110. In this arrangement, blow-by gas is able to pass through tube 108 to passageway 82 while lubricating oil exists solely on the wall of the crank chamber in the liquid state and tube 108 has its opening apart from the wall so that no liquid oil enters into the opening of the tube.

FIG. 18 illustrates a compressor according to the invention in which the oil deflector is symmetrically shaped to provide oil deflection irrespective of the direction of rotation of the compressor; i.e., oil is deflectedby the deflector to the oil opening and shaft seal cavity whether the compressor shaft is rotating in either the clockwise or counterclockwise direction. In this embodiment, the oil deflector **72*a* is in the shape of an isosceles triangle, as viewed in plan, such that when the compressor shaft rotates in the clockwise direction, oil from the interior housing wall is deflected along surface 74*a* to the oil opening section 100 in the direction of the solid arrows in FIG. 18, whereas compressor shaft rotation in the counterclockwise direction causes splashed lubricating oil to be directed along surface 74*b*** toward the oil opening as indicated by the broken-line arrows.

It will thus be apparent that the compressor of the invention provides improved efficiency of lubrication along with greater reliability of operation. More specifically, the compressor of the invention offers at least the following improvements over the conventional compressors:

The oil flow rate through all of the oil paths is nearly proportional to the shaft rotational speed.

Liquid oil on the compressor interior wall is isolated from the pressure-balancing hole to prevent oil from leaving the compressor chamber through this hole to the suction chamber and from there to the refrigerant system components.

The lubrication system works effectively over a wide range of compressor installation angles, and for both clockwise and counterclockwise directions of shaft rotation.

The proportion of lubricating oil that remains in the compressor chamber or crankcase so that leaving the crankcase to the external refrigerant system components is high, so that oil is saved and the heat exchanging efficiency at the evaporator and condenser is considerably higher.

Reed valve breakage trouble related to liquid pumping which occurs in the conventional compressors, because of a lack of liquid oil in the suction line and suction chamber in the cylinder head after a long shutdown of the refrigerating system, is eliminated.

Moreover, whereas the present invention has been specifically described herein with references to several presently preferred embodiments thereof, it is to be understood that the oiling system of the invention may be applied in any type of compressor which has a rotational piston drive assembly, and that variations to the specifically described embodiments of the invention may be made all without necessarily departing from the spirit and scope of the invention.

What is claimed is:

1. A compressor including a compressor housing having a discharge chamber which includes an inlet and an outlet, means for controlling the flow of fluid between the inlet and outlet of said discharge chamber a plurality of cylinders in said housing piston means including a shaft for imparting reciprocating motion of said piston means in said cylinders to compress a refrigerant fluid therein, a front housing on said compressor housing including an opening for receiving said shaft, means being provided to effect fluid communication between said shaft seal cavity and the interior of said compressor housing, an oil deflector depending from the inner wall of said compressor housing, said front housing including an oil opening disposed adjacent said oil deflector and a passageway formed therein effecting communication between said oil opening and said shaft seal cavity, whereby oil on the inner wall of said housing is directed by said deflector through said oil opening and into said shaft seal cavity, an oil bypass opening for allowing blow-by gas to be discharged from the interior of said housing, and a protective member circumferentially spaced along said housing inner wall from said oil deflector and projecting from said inner wall beyond said bypass opening, thereby to prevent oil from entering into said bypass opening.

2. The compressor of claim 1, in which said means for effecting fluid communication between said shaft seal cavity and said housing interior includes a second passageway formed axially through said shaft.

3. The compressor of claim 1, in which said passageway includes a first section in direct communication with said housing interior and a second section having a reduced width as compared to said first section intermediate said first section and said shaft seal cavity.

4. The compressor of claim 1, in which said protective member is in the form of a tube extending from said bypass opening and including an end portion projecting downward from said bypass opening and away from said casing wall.

5. The compressor of claim 1, in which said protective member includes an arcuate rib projecting from said housing wall and defining with said housing wall an oil-isolating enclosure for said opening.

6. The compressor of claim 1, in which said deflector is in the form of a triangle as viewed in plan and having one side surface tapering toward said opening.

7. The compressor of claim 6, in which said deflector terminates in a flat tip portion adjacent to but offset from said oil opening.

8. The compressor of claim 3, in which said deflector is substantially in the form of a right triangle as viewed in plan.

9. The compressor of claim 3, in which said deflector is substantially in the form of an isosceles triangle as viewed in plan.

10. The compressor of claim 3, in which said tapered wall has an arcuate channel formed therein for channeling the flow of oil therealong.

11. A compressor comprising a housing having a discharge chamber including an inlet and an outlet, means for controlling the flow of fluid between the inlet and outlet of said discharge chamber, a plurality of cylinders in said housing, piston means, means including a shaft for imparting reciprocating motion to said piston means in said cylinders to compress a refrigerant fluid therein, a front housing on said housing including an opening for receiving said shaft, and a shaft seal cavity disposed about a portion of said shaft, means being provided to effect fluid communication between said shaft seal cavity and said crank chamber, said front housing having an oil opening and a communication passageway formed therein effecting communication between said oil opening and said shaft seal cavity, an oil deflector depending from the inner wall of said housing and having a reduced width tip portion in close proximity to said oil opening, a relatively wider base portion spaced from said tip portion and away from said oil opening, and at least one slanted wall surface extending between said tip and base portions; whereby oil collecting on the inner wall of said housing is directed along said slanted surface and into said oil opening.

12. The compressor of claim 11, in which said passageway includes a first section in direct communication with the interior of said housing and a second section having a reduced width as compared to said first section intermediate said first section and said shaft seal cavity.

13. The compressor of claim 11, in which said deflector is in the form of a triangle as viewed in plan and has one side surface slanting in a direction toward said oil opening.

14. The compressor of claim 13, in which said deflector is substantially in the form of a right triangle, as viewed in plan.

15. The compressor of claim 13, in which said deflector is substantially in the form of an isosceles triangle, as viewed in plan.

16. The compressor of claim 13, in which said slanted wall surface has an arcuate channel formed therein for channeling the flow of oil therealong to said oil opening.

* * * * *